US007073977B2

(12) United States Patent
Unterweger

(10) Patent No.: US 7,073,977 B2
(45) Date of Patent: Jul. 11, 2006

(54) GLIDING DEVICE FOR SURFBOARDS

(76) Inventor: Walter Unterweger, Stollenweg 3, A-9020 Klagenfurt (AT)

( * ) Notice: Subject to any disclaimer, the term of this patent is extended or adjusted under 35 U.S.C. 154(b) by 0 days.

(21) Appl. No.: 11/239,354

(22) Filed: Sep. 30, 2005

(65) Prior Publication Data

US 2006/0093435 A1 May 4, 2006

Related U.S. Application Data

(63) Continuation of application No. PCT/AT04/00109, filed on Mar. 26, 2004.

(30) Foreign Application Priority Data

Mar. 31, 2003 (AT) ..... A 495/2003

(51) Int. Cl.
*A63B 69/00* (2006.01)
*A63G 21/18* (2006.01)

(52) U.S. Cl. ..... 405/79; 472/128; 472/129; 472/135; 4/491

(58) Field of Classification Search ..... 405/79; 4/491; 472/128, 129
See application file for complete search history.

(56) References Cited

U.S. PATENT DOCUMENTS 3,489,408 A 1/1970 Goodrich
3,802,697 A * 4/1974 Le Mehaute ..... 405/79
4,762,316 A * 8/1988 Merino ..... 472/88
5,213,443 A 5/1993 Hemperly et al.
5,342,145 A * 8/1994 Cohen ..... 405/79
5,387,159 A * 2/1995 Hilgert et al. ..... 472/128
5,401,117 A 3/1995 Lochtefeld
6,168,551 B1 * 1/2001 McGuinness ..... 472/135

FOREIGN PATENT DOCUMENTS

DE 25 12 152 A 10/1976
EP 0 041 160 A 12/1981

* cited by examiner

*Primary Examiner*—Frederick L. Lagman
(74) *Attorney, Agent, or Firm*—Dickstein Shapiro Morin & Oshinsky LLP

(57) ABSTRACT

The invention relates to a transport and gliding device for surfboards, comprising a guided stream of water influencing the action of the surfboard, and a plurality of flexible parallel tubes (1) which are inclined at an angle (2) and have a non-abrasive, pressure-insensitive cover. Water flows upstream through said tubes which are preferably arranged or fixed on a solid base with spac-ers. In the region of the board gliding thereover, the cross-section of the tubes is reduced to a maximum value of zero by the gliding and squashing edge (5) of the board. In this way, the upwardly flowing water column (3) in the tube moves the board (4) with the surfer upwards. Strong jets of water (8) are also sprayed upwards on the surface of the tube, hitting the lower side of the board when it tilts and thus also pushing the board with the surfer upwards. The inventive gliding device can either be used in a buoyant manner on a lake, on the land or in areas with pools.

8 Claims, 2 Drawing Sheets

GLIDING DEVICE FOR SURFBOARDS

This application is a continuation of International Application No. PCT/AT04/00109, filed Mar. 26, 2004.

BACKGROUND OF THE INVENTION

1. Field of the Invention

The invention relates to a transport and sliding device for surfboards comprising a guided stream of water influencing the surfboard.

2. Description of the Related Art

The previous state of the art ranges from surfboards which are used on natural water waves to those used on artificially created water waves wherein large amounts of water flow over artificial molded pieces, involving a large expenditure of energy. In case of these artificial water waves suitable for surfing, the agitated water film must be very thick so that, when set on edge, the surfboard does not glide off on the molded surface located underneath. Furthermore, flexible plastic webs capable of being rolled up and comprising a lateral water supply or water-filled rib-like formations, over which the water flows down in the form of cascades, are known. From U.S. Pat. No. 5,401,117 to Lochtefeld, issued Mar. 28, 1995, a device for water sliding—also using surfboards—is known, wherein water flows over an inclined artificial surface.

SUMMARY OF THE INVENTION

The technical problem solved according to the invention is the construction of a transport and sliding device comprising a novel surface, which allows surfing on specially designed boards involving an expenditure of energy that is substantially smaller than in case of the previously known artificial surfing waves having a continuously closed thick water film. Using this surface, it is possible to construct substantially larger surfable areas exhibiting large level differences, since a major part of the water flows upwards in flexible tubes.

The novel surface enables the surfer to move upwards with the surfboard through the water column flowing upwards in the tube system.

A further embodiment of the invention consists in that, on the top side of the tubes in addition to their internal water columns in the tube system, water jets spray upwards superficially in sections and additionally push the surfboard set on edge upwards when they impinge on it.

An additional embodiment of the invention consists in the specific design of the lateral edge of the board which is configured as a slide and squish edge having a circular cross-section.

BRIEF DESCRIPTION OF THE DRAWINGS

Further features, advantages and details of the invention are described in further detail by way of the schematic illustrations in the drawings, in which.

DETAILED DESCRIPTION OF THE PREFERRED EMBODIMENT

Figure 1:
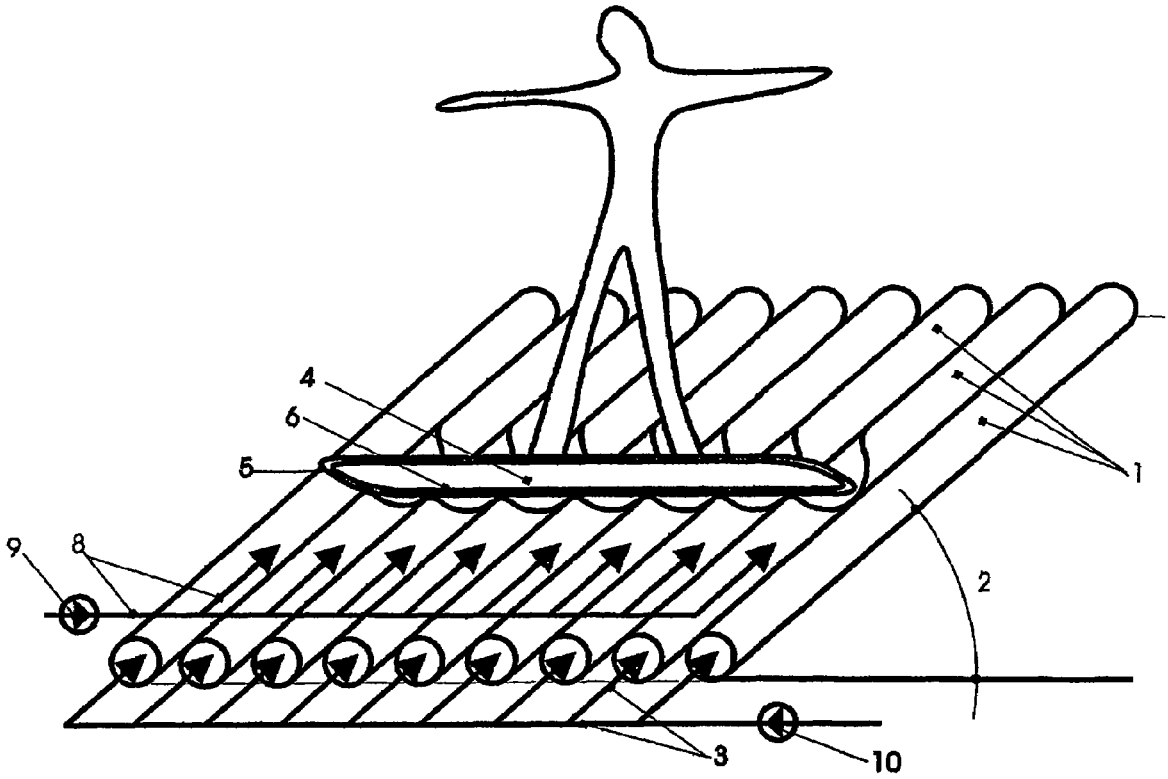
FIG. 1 is a general view of a surfer on a transport and sliding device illustrated only partially, rather than in full length and width.
Figure 2:
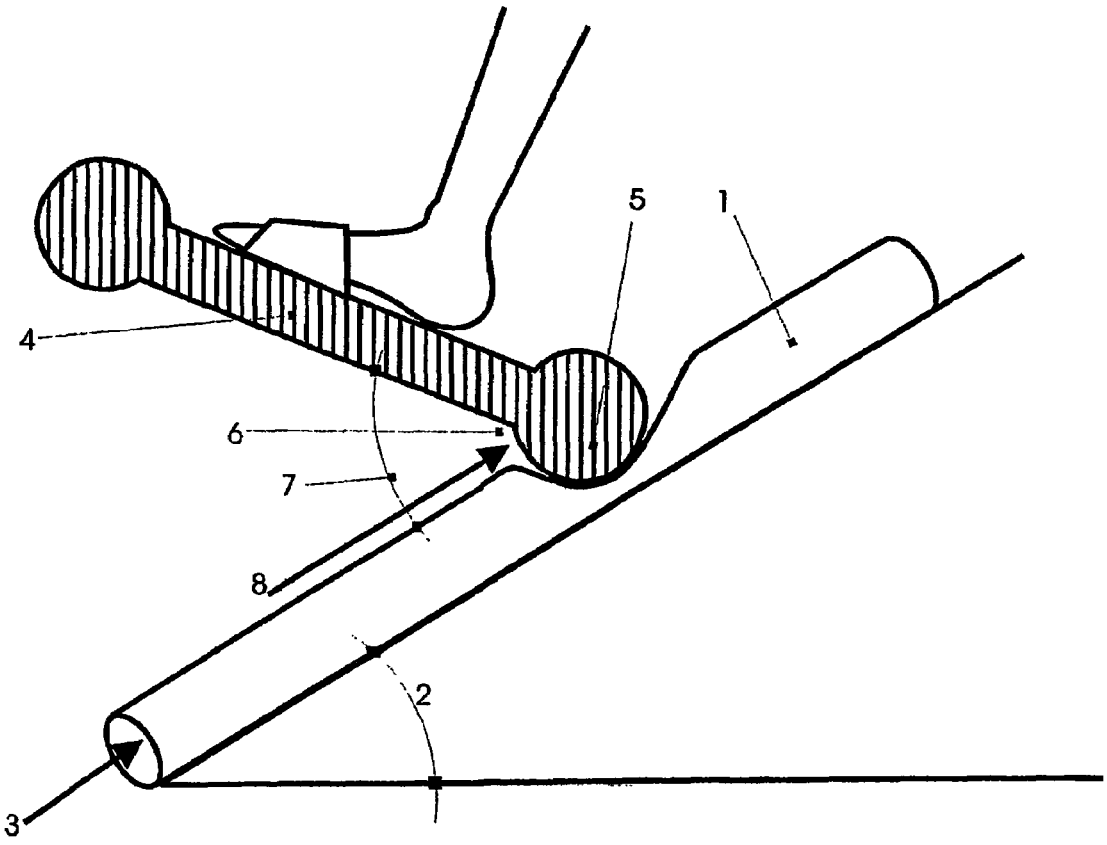
FIG. 2 shows a section through the surfboard on the sliding surface.

The new transport and sliding device for surfboards consists of a plurality of flexible, woven, high-strength plastic tubes 1 in different lengths, which are arranged in parallel and next to each other. These tubes are mounted on a foundation made of various materials at an angle 2 relative to the reference surface in a linear or curved fashion or in a combined form made up of straight and curved sections. The number of the tubes 1 applied side by side depends on whether the device is a transport and sliding device for individual surfers or for several surfers at the same time. The individual tubes are kept in an exact position relative to each other by metal or plastic sections, and those enable, at the same time, a precise squeezing of the tubes by the board edge 5 (slide and squish edge) which is sliding across. The transport and sliding surface thus created can now either be placed on solid ground or mounted freely with spacer supports. In the tubes 1, water is pumped up 3 via a commercially available pump system 10. In the area of the board 4 which is sliding across, the tube is pinched off by the weight of the surfer via the tilting, slide and squish edge 5 of the board, and the water column 3 flowing upwards in the tube thus pushes the board with the surfer on it upwards. The water pressure in the flexible tubes is adjusted such that the weight of a surfer with an average weight is sufficient for squeezing the tube to zero throughout the entire length of the board's lateral edge configured as a slide and squish edge 5. In the sliding phase, the surfer can thus use the buoyancy created by the water jet 8 as well as the buoyancy created by the water column 3 flowing upwards in the tube.

The dimension of the newly developed board, which is manufactured from wood, plastic, metal or from combinations of said materials, is adjusted to the size and weight of the person surfing therewith. The smaller the weight of the person, the shorter the selected board should be, so that the surface pressure of the squish edge 5 will be sufficient for squeezing all the tubes lying underneath if the angle 7 of the board is set on edge. In order that the squish edge 5 can, at the same time, also assume the function of the slide edge, it has, on average, a circular cross-section. In this way, it is ensured that the board can slide well in any position on the surfing-sports surface according to the invention, without damaging the tube surface.

On the bottom side of the board, the tilting, slide and squish edge turns directly into a rebounding surface 6, which, in case of different attack angles of the board, provides for an optimum transmission of energy from the impinging water jet to the board. Thus, the kinetic energy is transferred from the water jet 8 to the board without major losses.

In addition, between the tube elements 1 passed through by water, strong water jets 8 are sprayed upwards by the pump system 9, thereby forming a water film between the board and the tube when sliding with the board lying flatly on the surfing-sports surface, which water film allows the board to slide well. However, if the board is set on edge by the surfer 7, the water jets hit the rebounding surface 6 on the bottom side of the board and hence push the board 4 upwards additionally. In this way, areas of the transport and sliding device can be sprayed with water jets going upwards. In these areas, the additional buoyancy then serves to move the surfer upwards reliably. In other areas of the surface, the water is simply allowed to drain off downwards. In these areas, sliding and swinging in a downward direction becomes possible, however, the surfer can slide back up reliably only in the areas with the strong water jet 8.

The athlete can either get on at the upper end of the surfing-sports surface, which is suitable especially for beginners as they come into the sliding motion immediately, or advanced athletes can get on also in the lower area of the surfing-sports surface and use the buoyancy for sliding upwards across the surface.

The transport and sliding devices according to the invention can either be arranged so as to float directly on a lake, mounted to floating bodies, or they can be located in a hall with a transportable or fixedly installed basin, or they can be placed in the open air on a hillside with water-collecting basins in the lower area of the surfing-sports surface.

What is claimed is:

1. A transport and sliding device for surfboards (4), comprising an upward stream of water (3, 8) influencing a movement of the surfboard (4), wherein the transport and sliding device is formed by a plurality of flexible tubes (1) arranged in parallel and next to each other, with an inclined surface being formed, which tubes are passed through by water in an upward direction and are squeezable by means of a surfboard (4) loaded with a person, whereby the cross-section is constricted at least partially.

2. A transport and sliding device according to claim 1, wherein, on the top side of the surface formed by the tubes (1), water jets (8) can be sprayed upwards at least in sections.

3. A transport and sliding device according to claim 1, wherein the cross-section of the tubes (1), and hence the water flow rate through the tubes (1), can be minimized to zero by squeezing with a surfboard (4).

4. A transport and sliding device according to claim 1, wherein the surface formed by the tubes (1) is flat.

5. A transport and sliding device according to claim 1, wherein the surface formed by the tubes (1) has a curved design.

6. A transport and sliding device according to claim 1, wherein the tubes (1) are formed from a woven, high-strength synthetic material.

7. A transport and sliding device according to claim 1, in combination with a surfboard (4), wherein the surfboard (4) is provided with lateral edges (5) having circular, preferably toric cross-sections.

8. A transport and sliding device according to claim 1, wherein the surfboard (4) has lateral edges (5) that turn directly into a rebounding surface (6) on the bottom side of the board.

* * * * *